United States Patent [19]

Hildebrand

[11] Patent Number: 4,740,021

[45] Date of Patent: Apr. 26, 1988

[54] LOCKING DEVICE FOR A SIDE OR TAIL BOARD OF A TRUCK

[75] Inventor: Klaus Hildebrand, Erkrath, Fed. Rep. of Germany

[73] Assignee: Karl Hildebrand GmbH & Co. KG, Erkrath, Fed. Rep. of Germany

[21] Appl. No.: 922,346

[22] Filed: Oct. 23, 1986

[30] Foreign Application Priority Data

Oct. 25, 1985 [DE] Fed. Rep. of Germany ..... 3538076

[51] Int. Cl.[4] ..... E05C 3/06

[52] U.S. Cl. ..... 292/196; 292/5; 292/DIG. 55

[58] Field of Search ..... 292/196, 5, DIG. 49, 292/DIG. 43, DIG. 55, DIG. 40, DIG. 39

[56] References Cited

U.S. PATENT DOCUMENTS

| | | | |
|---|---|---|---|
| 1,542,092 | 6/1925 | Rasmussen | 292/198 x |
| 2,719,048 | 9/1955 | Hayes | 292/198 X |
| 3,124,378 | 3/1964 | Jackson | 292/198 X |
| 3,583,740 | 6/1971 | Armstrong | 292/198 |
| 4,458,940 | 7/1984 | Hildebrand | 292/DIG. 60 X |

FOREIGN PATENT DOCUMENTS

| | | | |
|---|---|---|---|
| 0001112 | 3/1979 | European Pat. Off. | 292/196 |
| 2932763 | 2/1981 | Fed. Rep. of Germany . | |
| 2936528 | 3/1981 | Fed. Rep. of Germany . | |
| 1321314 | 2/1963 | France | 292/5 |
| 168386 | 6/1934 | Switzerland | 292/198 |
| 2026594 | 2/1980 | United Kingdom | 292/5 |

*Primary Examiner*—Gary L. Smith
*Assistant Examiner*—Curtis B. Brueske
*Attorney, Agent, or Firm*—Fleit, Jacobson, Cohn & Price

[57] ABSTRACT

The locking device is provided with a jaw for receiving a swinging pin or trunnion, e.g. on the side or tail board of a truck or lorry, as well as with a bolt for the jaw opening. It also has a pivotably mounted claw movable by the bolt by means of a cotter gear and this claw grasps said pin as soon as it is in the pivoting region of the claw and forces it into the jaw. The bolt is advanced synchronously with the claw movement. The swinging pin is held by the bolt with supporting of the claw in the jaw.

19 Claims, 5 Drawing Sheets

LOCKING DEVICE FOR A SIDE OR TAIL BOARD OF A TRUCK

FIELD OF THE INVENTION

The invention relates to a locking device, e.g. for the tail board or side of a truck or lorry, with a stationary jaw for receiving a swinging or pendulum pin and with a locking bolt for the jaw. Importance is attached to easy manipulation, as well as to the actual locking function in connection with locking devices for the hinged or swinging tail boards of trucks, so that a device with a jaw is provided. On closing the tail board a pendulum or swinging pin fitted there passes into the vicinity of the jaw, where it is guided into a clearly defined end position. This guidance is necessary because the movable part with the swinging pin is often tilted with respect to the stationary part, alignment taking place forcibly by the jaw.

BACKGROUND OF THE INVENTION

DE-OS No. 27 40 573 discloses a locking device for the tail board or sides of trucks, which is provided with a swivel bolt, which is mounted in a housing by means of a pin. Within the housing is formed a force transfer zone, on which engages a two-armed angular pressure piece, which is also mounted by means of a pin. A manual rocking lever is articulated to one arm of the angular pressure piece. If a swinging pin passes in to the vicinity of the open swivel bolt, then by means of the manual rocking lever an operator deflects the angular pressure piece outwards acting on the compressive force transfer zone of the rocking lever. In order to reduce the frictional forces which occur, a roller with a pin is mounted in this zone on the rocking lever. As a result of the force transfer, the swinging pin is forced into the jaw. On opening the angular pressure piece engages on a cam extension on the swivel bolt, which is moved outwards. To ensure that the tail board pin is held in rattle-proof manner in the closed position, the swivel bolt is at least partly made from an elastic material. In addition, a slot is provided in which are located two disk springs, which press the elastic bolt zone onto the swivel pin.

This locking device suffers from the disadvantage that all the closing a retaining forces acting on the swivel bolt have to be absorbed by the swivel bolt trunnion and the angular pressure piece trunnion. If one of these trunnions or a pivot bearing does not withstand this pressure, the trunnion jumps out of the jaw. There is also a risk of the swivel bolt breaking in the case of an excessive pressure of the trunnion, especially as it is slotted. With regards to the roller, it is to be expected that when transporting highly corrosive products, e.g. artificial fertilizers, residues will collect in the interior of the housing and the roller will become blocked through rust.

DE-OS No. 29 32 763 discloses a locking means for hinge down and swing out tail boards of trucks, in which a locking rocker fulfills the function of bringing the swinging pin into the jaw and maintaining it therein. The manually operable locking rocker is articulated pivotably to a jaw part by means of two connecting rods. The locking rocker is held in the closed state by a safety catch. It is a disadvantage of this locking device that all forces have to be absorbed by the swivel bearing bolt, so that there is a risk of breakage in the case of higher forces.

DE-OS No. 29 36 528 discloses a long-path locking means for hinge down and swing out tail boards, which is operable by means of a handle with a dead centre means. Upstream of a jaw is located a pivotable locking rocker, which is mounted by means of a bolt in the side walls of housing. In a further bolt, a toggle lever is articulated to the locking rocker and is connected by means of a knuckle joint to a second toggle lever also mounted in the housing wall with a bolt. This lever mechanism, which assumes a beyond dead centre position when the locking rocker is closed, is moved by means of a push rod suspended on the knuckle joint and leading to the handle, a lever action being exerted on the locking rocker by means of the toggle levers. It is a disadvantage of this locking device, that the reliability and operation are exclusively dependent on the bolts and if a single bolt fails it can no longer fulfill its function. In addition, all joints are naturally subject to wear, so that at least in the case of frequent operation and vehicle and swinging pin impacts the ball and socket joints can become deflected. This disadvantage cannot be compensated by the tensioning or clamping function of the beyond dead centre system, because such systems perform a setting movement. It is not possible to readjust the clearance of the articulated points, so that rattling occurs during all vehicle movements following a certain amount of wear, whereby such rattling must be avoided so as not to make the work place unduly noisy.

Finally, DE-OS No. 29 40 671 discloses a locking device for walls, doors, flaps and reciprocally pivotable plates, in which the trunnion pin is held in the jaw by a displaceable bolt. The end of the bolt is constructed as a gripper for engaging in a corresponding recess on the trunnion pin. As soon as the bolt grips the trunnion pin, there is a centering and guidance in the jaw. The bolt is guided in a stable housing, which absorbs in large-area manner the forces from the swinging pin. This locking device admittedly functions reliably, but for trapping the swinging pin it has to be introduced a relatively long way into the jaw opening.

OBJECT OF THE INVENTION

The object of the invention, in the case of a locking device of the aforementioned type is to increase the trapping area on the jaw for the trunnion.

SUMMARY OF THE INVENTION

This object is achieved in that a pivotably mounted claw driven by the bolt in the direction of the jaw opening is provided which, when the bolt is open, is swung out from the jaw opening, which during the translatory movement of the bolt performs a swinging movement in the vicinity of the jaw opening and which when the bolt is closed is positioned upstream of the jaw.

The function of this locking device is based on the fact that in a first phase the claw grips the swinging pin and brings the same into the engagement area of the bolt. In a second phase the claw supports the bolt when taking and aligning the same in the jaw. However, in the closed static state the claw is relieved by the bolt. The swinging pin is doubly secured both by the bolt and by the claw. This has the advantage that both the ease of operation and the reliability of the locking device is increased. According to an advantageous further development of the invention, the gear between the bolt and the claw is constructed as a cotter gear, comprising a cotter and a control bevel. This measure has the advantage that a compact construction of the locking device with small external dimensions is possible. If wear to the gear should make readjustment necessary, then reworking is easy, because only flat gear parts are affected. It is particularly advantageous if the cotter and precontrol bevel engage flat on one another with the bolt closed. The claw is reliably held in the closed position by this positive connection. It has also proved advantageous for the claw to have a centering and retaining bead for engaging in a corresponding slot-like recess on the swinging pin. This has the advantage that the trapping of said pin is facilitated. The centering and retaining bead corrects the movement sequence or position of the swinging pin in such a way that it is reliably grasped by the bolt.

According to a preferred embodiment of the invention, the bolt head has a forked construction and the claw is mounted in the fork opening. As a result of this measure all the sliding faces of the claw are in contact with bolt faces, so that the frictional forces occurring there assist the movement of the claw. This arrangement also has the advantage that the fork parts engage on the swinging pin on either side of the claw and consequently any torsional forces from said pin cannot have any effect on the claw.

According to a further development of the locking device, the bolt has a driver guided in a guideway in the claw. Driver and guideway bring about a precontrol of the movement sequence and have an assisting action on opening the locking device. Although when the locking device is positioned vertically an automatic opening of the claw is normally ensured by its own weight, this driver system makes it possible to overcome a temporary sticking of the claw, e.g. as a result of adhesive material being carried in the truck.

The driver preferably comprises a cam and the guideway a slot, whose configuration is adapted to the superimposed pivoting and translatory movement of the claw or bolt. The curved configuration of the slot prevents the bolt and claw from passing into a dead centre.

According to a further development of the invention a bolt-controlled catch is provided, which engages on the claw when the bolt is opened. This catch acts automatically, i.e. without any influence being necessary thereon by the locking device operator. The claw is held in the swung out position when the bolt is open, which prevents rattling in the case of a vehicle movement.

According to an advantageous development, the catch comprises a pin provided with a chamfer and locating in the claw pivot axis for positive connection with a mating surface on the bolt. This catch is chracterized by its simple construction.

According to an advantageous further development of the invention the bolt is guided in a bolt housing and the claw has a rounded end for a swinging or pivoting movement, with which it is mounted in a cavity formed from the housing bottom and a bolt recess.

According to a further development of this mounting system, the claw is secured by means of a bolt member guided in its pivot axis and held in the bolt housing.

According to a further, particularly advantageous development of the invention the bolt is provided with an extension arranged laterally with respect to the two fork parts and having a guidance surface for the trunnion and which can be moved as a lateral jaw boundary into the jaw. This guidance surface assists the alignment of the swinging pin in the jaw. This is brought about on the one hand through acting as a stop member for the swinging pin head and on the other hand in that through the bolt movement the swinging pin is actively moved into a position in which it can uniformly engage on the two fork parts.

This extension is preferably guided in a three-wall guide web laterally terminating the jaw. This construction is able to absorb all the forces acting on the extension. It also has the advantage that the neck is stiffened by the side wall. In place of a free jaw part resting on a neck, there is consequently a partly closed jaw housing. This e.g. ensures that during a tilting movement when the tail board is placed on loose material or the like, the jaw is not forced upwards by the swinging pin or broken off.

An undisturbed operation of the locking device is particularly obtained if a dirt channel passes along the bolt starting from the bearing opening, the cotter and the control bevel. As a result of these given shapes and chamfers, any dirt, such as e.g. sand penetrating from above into the bolt housing is removed downwards. This ensures that no dirt particles collect and the mobility of the locking device parts if not impaired.

A simple and reliable operation of the locking device is obtained in that the bolt is connected by means of a push rod with a pivotable handle which is located in the dead centre position when the bolt is closed. If the length of the push rod is variable, the cotter gear can be readjusted by a slight lengthening of the push rod.

According to an advantageous further development of the locking device, the bolt is longitudinally subdivided into two and the bolt part connected to the push rod is connected to the other bolt part in rotary manner, preferably about an angle of 90°. This measure is particularly advantageous if the locking device is used for closing a tail board at the rear. The bolt and the handle to be swung out are then preferably positioned with an angle of , 90°, so that despite a rearwardly directed jaw the swinging movement of the handle takes place to the side. Therefore the operator does not have to pass into the folding area of the tail board and can instead operate the locking device in unimpeded manner from the side. It is also advantageous that in this way the dead centre system can be used unchanged for left-side and right-side housing forms.

The connection point or junction of the two bolt parts is preferably within the housing, so that it is protected from any action.

According to a preferred development of the invention, the housing height is no more than 40 mm. This has the advantage that for a given maximum vehicle width of e.g. 2.50 m and with a two-sided arrangement of the locking device, the available loading width can be utilized up to an interior dimension of 2.42 m. For example, this loading width makes it possible to load in juxtaposed manner two so-called Euro-pallets.

BRIEF DESCRIPTION OF THE DRAWINGS

The invention is described in greater detail hereinafter relative to an embodiment.

DESCRIPTION OF THE PREFERRED EMBODIMENT

Figure 1:
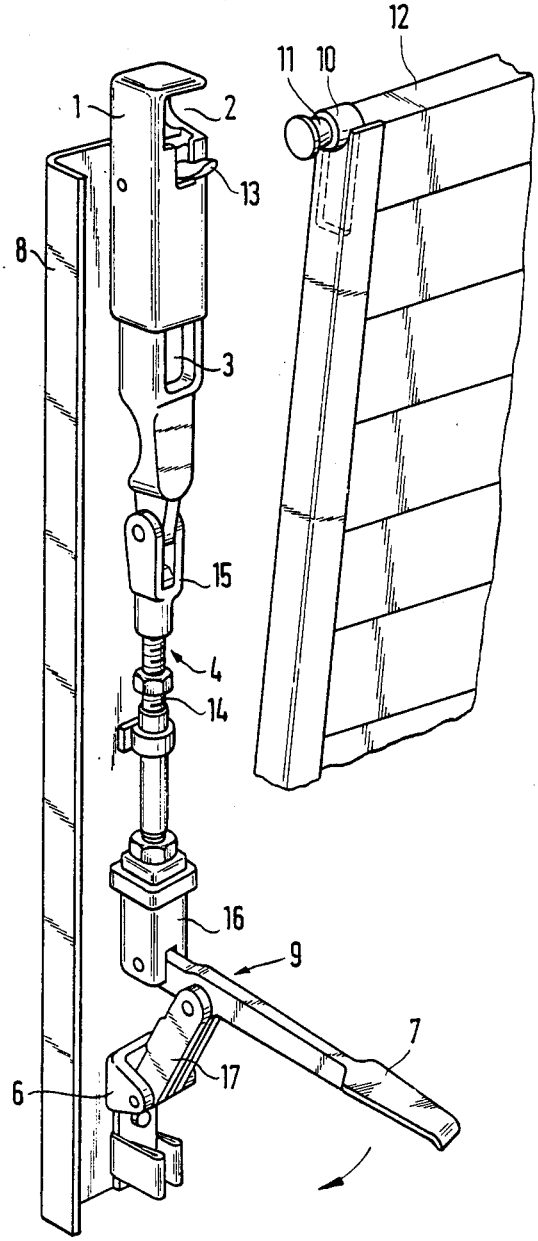
FIGS. 1 and 2, in each case show an overall view of the locking device in the open/closed state.

As is shown in FIG. 1, the locking device is fitted in stationary manner to a stanchion 8 in a vertical arrangement. In the represented embodiment, it is a left-sided part, which is apparent from a left-sided, completely closed housing 1, so that a jaw 2 for a swinging pin 10 is bounded on the left-hand side. A corresponding right-sided construction of the locking device differs in that the jaw 2 is terminated by housing 1 on the right-hand side and is open on the left-hand side. The swinging pin 10 is fitted to a side or tail board 12. It has an all-round recess 11 with chamfered side faces, which aid the trapping by a claw 13 and the centering and alignment in jaw 2.

In housing 1 is guided a bolt 3, which is connected by means of a length-adjustable thrust arm 4 with a beyond dead centre operating system 9. The length of thrust arm 4 is brought about by means of a threaded rod 14, which is connected on the one hand to a fork 15 on bolt 3 and on the other hand by means of a further fork 16 to a pivotably articulated handle 7. Handle 7 is held in articulated manner in a bearing 6 by means of a lever 17.

Figure 2:
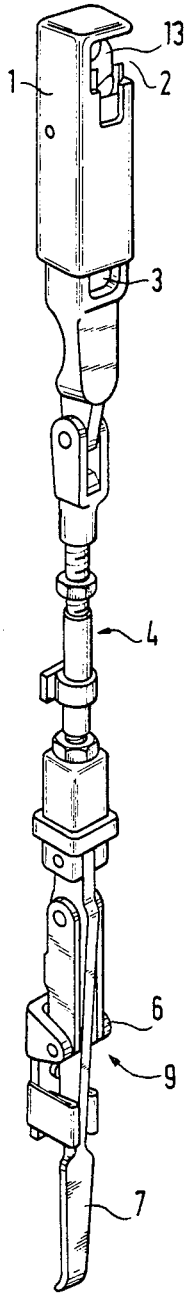

For closing or locking the device, handle 7 is pivoted in the direction of the arrow, so that it assumes the position shown in FIG. 2. During this pivoting movement, bolt 3 is moved upwards into jaw 2, whilst synchronously thereto claw 13 performs a pivoting movement out of the swung out position shown in FIG. 1 until it is positioned upstream of jaw 2 with the bolt closed. Tail board 12 and swinging pin 10 are not shown in FIG. 2 in order not to overburden the drawing. As will be shown hereinafter one of the functions of claw 13 is to grasp the swinging pin 10, as soon as it is in its swinging or pivoting range and press it into jaw 2.

Figure 3:
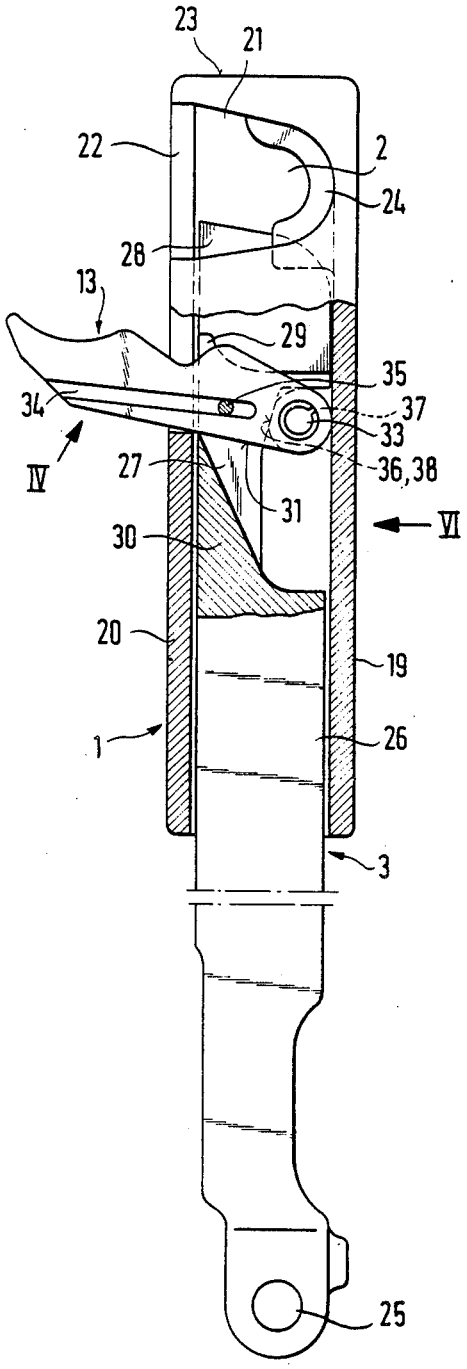
FIG. 3, diagrammatically shows details of the locking device in the open state.

FIG. 3 diagrammatically shows the arrangement of bolt 3 and claw 13 in housing 1, housing 1 and bolt 2 being partly cut away along their median longitudinal axes.

Housing 1 comprises a closed base plate 19, two side walls and a cover plate 20. One side wall is provided with a downwardly tapering opening 21 for forming the jaw. The other side wall is contructed as a guide web 22 in the vicinity of jaw 2. End face 23 of housing 1 forms the upper boundary of jaw 2. In the vicinity of jaw 2 a centering bead 24 is formed centrally on base plate 19.

The bolt 3 provided at its rear end with a fork connection 25 comprises a block part 26 with a rectangular cross-section, whose free end (bolt head) 27 has a fork-like construction, claw 13 being guided in the central fork opening. Bolt head 27 has an extension 28 guided laterally along guide web 22 with a guide face directed into the jaw for the swinging pin. Behind the fork opening bolt 3 is also provided with a chamfer which, as will be shown hereinafter, acts as a cotter 30 for claw 13.

The back of claw 13 serves as a control bevel 31 which, in conjunction with cotter 30 forms a cotter gear. The bearing end of the claw is rounded, so that during a pivoting movement it rolls on the housing bottom 19. it is laterally guided by the two fork parts 29. In the represented embodiment, claw 13 is pivotably articulated by means of a bolt member 33 between the housing walls. A slot 34 is provided laterally on claw 13 for the precontrol of the cotter gear and in it engages a cam 35 from a fork part 29. Around the pivot axis of claw 13 is laterally formed a cam 37 provided with a chamfer 36. When bolt 3 is open, i.e. when the claw 13 is completely swung out in accordance with FIG. 3, a mating surface 38 formed on bolt 3 engages positively on chamfer 36. Chamfer 36 and mating surface 38 together form a catch controlled by bolt 3 and which engages for fixing claw 13.

Figure 4:
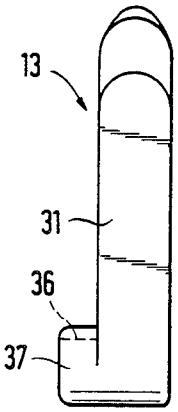
FIG. 4, is a plan view of a claw.

FIG. 4 is a plan view claw 13 in the direction of arrow IV. It is clearly possible to see the control bevel 31 and cam 37, whilst chamfer 36 is concealed as a result of the chosen view.

Figure 5:
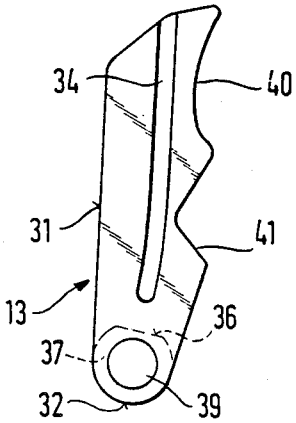
FIG. 5, is a side view of the claw according to FIG. 4.
Figure 6:
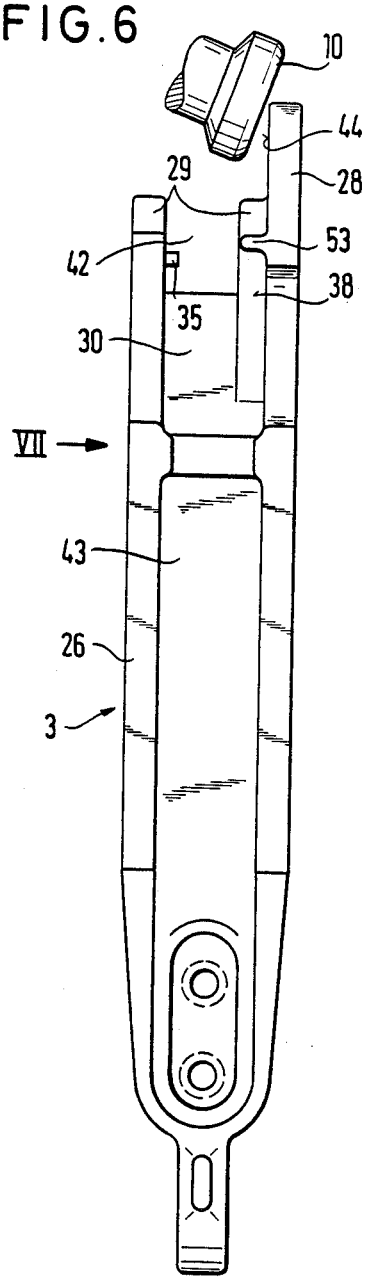
FIG. 6, is a plan view of a bolt.

Further details of claw 13 will now be described relative to FIG. 5. The free end of the claw is provided with a centering and retaining bead 40 as a counter part to centering bead 24 in housing 1 and said bead 40 runs in a concave recess. On the same side is provided a projection 41 for engaging with a driver 53 on bolt 3, as shown in FIG. 6. The guide for bolt member 33 carries reference numeral 39. In the example chosen in FIG. 5 the slot 34 has a curved configuration chosen in such a way that it is adapted to the superimposed pivoting and translatory movement of claw 13 or bolt 3. In a lower region where cam 37 is located when claw 13 is swung out, slot 34 is slightly curved to ensure that bolt 3 and claw 13 do not pass into a dead centre position here. The configuration of slot 34 is such that it has an angle of inclination, even when claw 13 is swung out perpendicularly.

FIG. 6 is a view of bolt 3 from the direction of arrow VI in FIG. 3. FIG. 6 clearly shows fork part 29 with the interposed fork opening 42 for receiving claw 13. With respect to block part 26, the fork opening 42 is bounded by the sloping face of cotter 30. It passes into a recess 43, which runs in slot-like manner along the entire block part 26. In this way a channel is formed along the entire bolt 3 and this channel serves to remove downwards dirt particles which have penetrated the housing via jaw 2. The mating surface 38 of the catch is formed on a step-like shoulder of a fork part 29 following onto driver 41. FIG. 6 also shows how cam 35 projects into fork opening 42.

In order to illustrate the function of extension 28, the head of swinging pin 10 is diagrammatically shown in an exaggerated tilted position. As a result of a longitudinal movement of bolt 3, head 10 is subject to a tangential force, which aligns it in jaw 2. This alignment is assisted by the fact that a guidance face 44 on the side of extension 28 slides along the end face of head 10.

Figure 7:
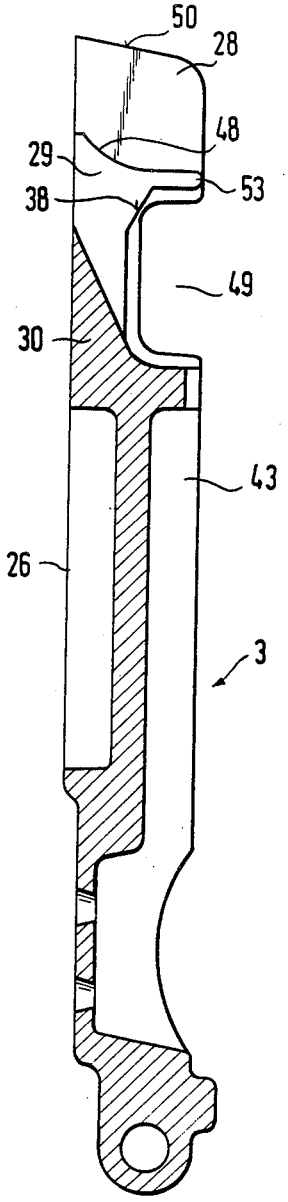
FIG. 7, is a cross-section through the bolt according to FIG. 6.

FIG. 7 shows the bolt in a longitudinal section along the centre line in a view according to arrow VII in FIG. 6. Along its end face 50, extension 28 is slightly chamfered in the direction of the housing base plate, so that on grasping the swinging pin the forcing into the jaw is assisted. The two fork parts 29 pass out into grippers 48, whilst adapting to the swinging pin cross-section. A bolt recess 49 is provided for pin 37.

Figure 8:
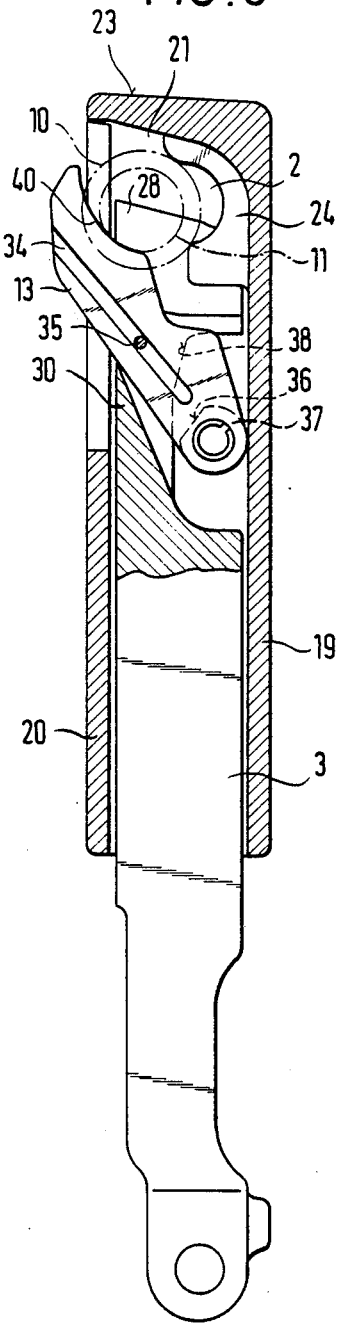
FIGS. 8 and 9, diagrammatically show details of the locking device in the half-closed and closed states.
Figure 9:
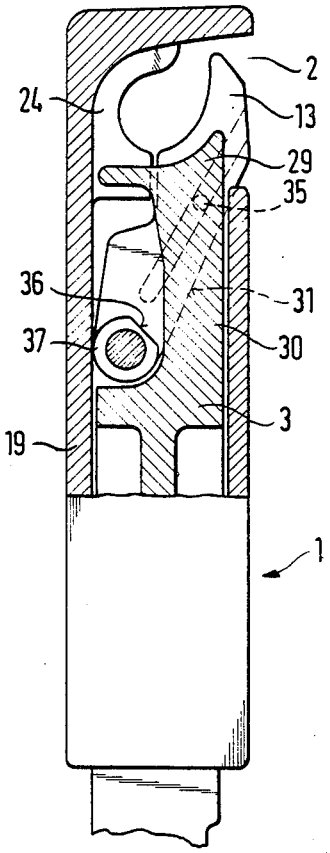
Figure 10:
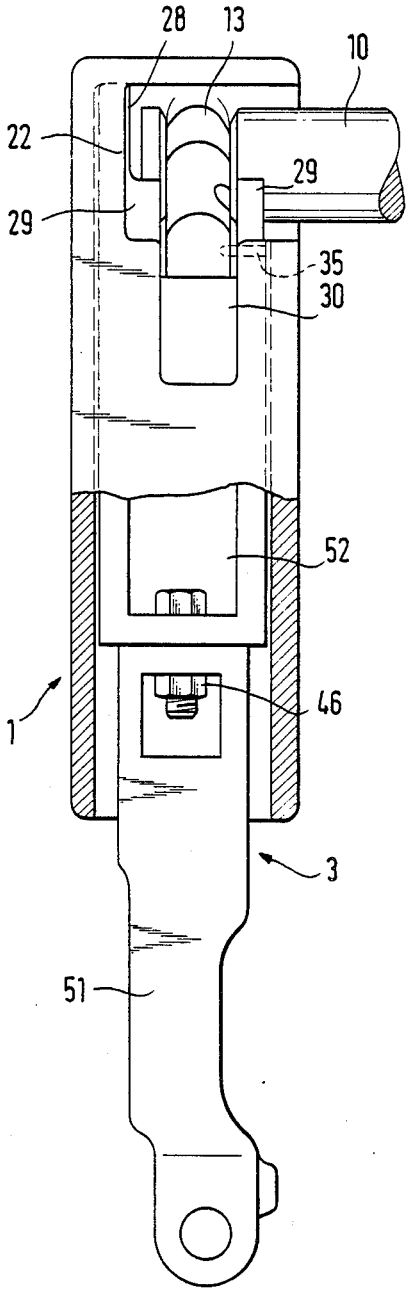
FIG. 10, diagrammatically shows a plan view of part of the locking device.

FIGS. 8, 9 and 10 show the housing 1 and bolt 3 in partly cutaway form, in order to cearly reproduce essential details of the locking device.

By means of FIGS. 1 to 8, the function of the locking device will now be described. When the bolt 3 is open, the catch comprising chamfer 36 and mating surface 38 hold the claw 13 positively in the supported position. On moving the bolt, contact is broken between chamfer 36 and mating surface 38, so that a pivoting movement of the claw 13 in the direction of jaw 2 is not prevented. Simultaneously cam 35 presses against the side wall slot 34 and controls a movement of claw 13. In addition, the cotter gear moves claw 13, in that the tip of cotter 30 presses on control bevel 31. During this movement pin 37 in a recess 49 of bolt 3 is out of contact with the latter. If there is a swinging pin 10 in the pivoting region of claw 13, then pin 10 is forced into jaw 2. The lateral alignment of swinging pin 10 is brought about in that the centering and retaining bead 40 engages in the adapted recess 11 (FIG. 1) of said pin. The vertical alignment of the swinging pin 10 takes if comes into contact with the extension 28 moving laterally into the jaw. FIG. 8 e.g. shows the situation in which the bolt 3 has covered roughly half the bolt travel. The swinging pin 10 is immediately in front of the centering bead 24. Extension 28 which is chamfered rearwards in the direction base plate 19 is advanced roughly up to the centre line of pin 10. Fork part 29 is still out of contact with pin 10.

FIG. 9 finally shows a cross-section through the locking device in the closed state. Cotter 30 is so far advanced in this position that the cotter face is in whole-area positive engagement with the control bevel 31. During the preceding movement following on to the situation according to FIG. 8, the fork parts 29 penetrate jaw 2 and engage with the swinging pin. In the closed position shown in FIG. 9 the cotter 30 completely arrests claw 13. The swinging pin, which is not shown for reasons of clarity, is on the one hand positively secured by the fork parts 29 at both ends of claw 13 and also by bolt 3, all the forces acting on the claw being transferred by means of cotter 30 to bolt 3 or the housing.

FIG. 10 shows the arrangement of fork parts 29 and claw 13 on swinging pin 10. It can be gathered from FIG. 10 that the extension 28 is mounted in guide web 22 and consequently contributes to stability and the absorption of forces. The forces acting on bolt 3 are consequently absorbed by the housing 1 in conjunction with extension 28.

On opening the locking device, when bolt 3 is retracted, The surface of cotter 30 is immediately disengaged from the control bevel 31, so that claw 13 is immediately freed. In the case of a horizontal arrangement, it is swung outwards by its own weight. In addition, the swinging out is assisted by cam 35 and slot 34. The forcibly controlled return link brings the claw back into the inital position of FIG. 3, in which it is held in clearance-free manner by the catch.

FIG. 10 shows the bolt 3 split longitudinally. The bolt part 51 connected to the push rod is rotated with respect to the other bolt part 52 by 90° compared with the arrangements shown in the other drawings. Thus, fork 15 together with the complete actuating means 9 (FIGS. 1 and 2) can also be rotated by 90°. The two bolt parts are detachably interconnected by means of a screw joint 46. By loosening this screw joint 46, it is possible at all times and without difficulty to reciprocally turn the two bolt parts. The junction is concealed in housing 1.

What is claimed is:

1. A locking device for a swinging side or tail board of a truck, said side or tail board having a swinging pin thereon, said locking device comprising a stationary jaw with a jaw opening for receiving said swinging pin, said locking device further comprising a sliding bolt slidably movable in the jaw by translatory movement, a pivoting claw (13) which is driven by said bolt (3) and which is pivotably mounted for movement inwardly into and outwardly of the jaw such that when said bolt (3) is in an open position, said claw is swung out from said jaw and wherein said translatory movement of said bolt (3) moves said claw in a swinging or pivoting movement inwardly into said jaw, said swinging pin being positioned in said jaw opening when said bolt is in a closed position, said bolt having parts which engage said swinging pin as said bolt moves from said open position to said closed position such that as said bolt moves from said open position to said closed position, said claw pivots inwardly into said jaw to force said pin into said jaw opening and when said bolt is in said closed position, said claw and said parts engage and positively secure said swinging pin in said jaw opening.

2. A locking device according to claim 1, wherein the bolt (3) comprises a cotter (30) and wherein said claw includes a back surface which serves as a control bevel (31).

3. A locking device according to claim 2 wherein said cotter (30) engages said control bevel (31) positively when said bolt is in said closed position.

4. A locking device according to claim 1, wherein the claw has a centering and retaining bead (40) for engaging in a corresponding slot-like recess (11) on said swinging pin (10).

5. A locking device according to claim 1, wherein the bolt includes a bolt head having a fork opening and wherein said claw (13) is mounted in said fork opening.

6. A locking device according to claim 1, wherein the bolt (3) has a driver guided in a guide way in said claw (13).

7. A locking device according to claim 6, wherein the driver comprises a cam (35) and the guideway comprises a slot (34) with a configuration adapted to move said claw (13) in said swinging or pivoting movement in response to said translatory movement of said bolt (3).

8. A locking device according to claim 1, wherein a catch is provided, said catch being controlled by said bolt (3) and catching said claw (13) when said bolt is in said open position.

9. A locking device according to claim 8, wherein the catch comprises a cam (37) located around said pivot axis and provided with a chamfer (36) for positively engaging with a mating surface (38) on said bolt (3).

10. A locking device according to claim 1, wherein the bolt (3) is guided in a bolt housing having a housing bottom and the claw is provided with a rounded end (32) so that during said swinging or pivoting movement said claw rolls on said housing bottom within a recess (49) in said bolt.

11. A locking device according to claim 1, wherein the claw is secured by means of a bolt member (33) guiding said claw about said pivot axis and held in a bolt housing.

12. A locking device according to claim 5, wherein the bolt has an extension (28) arranged laterally with respect to the parts (29) which engage said swinging pin, said fork opening located between said parts, said extension being provided with a guidance face (44) for the swinging pin (10) and which is movable within said jaw (2).

13. A locking device according to claim 12, wherein said jaw laterally terminates in a three wall guide web and wherein the extension (28) is guided in said three-wall guide web (22).

14. A locking device according to claim 5, wherein a dirt channel runs along said bolt (3) from the fork opening.

15. A locking device according to claim 1, wherein said bolt (3) is connected by means of a thrust arm (4) with a pivotable actuating mechanism, said actuating mechanism assuming a dead centre position when the bolt is in said closed position.

16. A locking device according to claim 15, wherein the length of said thrust arm (4) can be varied.

17. A locking device according to claim 15, wherein the bolt (3) is longitudinally subdivided into two bolt parts, one bolt part (15) being connected to said thrust arm (4) and to another bolt part (52) so as to rotate about a median longitudinal axis of said bolt parts and said thrust arm.

18. A locking device according to claim 17, wherein the two bolt parts (51, 52) have a junction within a bolt housing (1).

19. A locking device according to claim 18, wherein the housing has a height of no more than 40 mm.

* * * * *